US010690015B2

(12) United States Patent
Hirukawa

(10) Patent No.: US 10,690,015 B2
(45) Date of Patent: Jun. 23, 2020

(54) CYLINDER HEAD STRUCTURE FOR INTERNAL COMBUSTION ENGINE AND INTERNAL COMBUSTION ENGINE

(71) Applicant: ISUZU MOTORS LIMITED, Shinagawa-ku, Tokyo (JP)

(72) Inventor: Kouji Hirukawa, Kanagawa (JP)

(73) Assignee: ISUZU MOTORS LIMITED, Shinigawa-Ku, Tokyo (JP)

( * ) Notice: Subject to any disclaimer, the term of this patent is extended or adjusted under 35 U.S.C. 154(b) by 0 days.

(21) Appl. No.: 15/774,788

(22) PCT Filed: Nov. 2, 2016

(86) PCT No.: PCT/JP2016/082563

§ 371 (c)(1),
(2) Date: May 9, 2018

(87) PCT Pub. No.: WO2017/082131

PCT Pub. Date: May 18, 2017

(65) Prior Publication Data

US 2018/0320562 A1 Nov. 8, 2018

(30) Foreign Application Priority Data

Nov. 9, 2015 (JP) ..... 2015-219400

(51) Int. Cl.
*F01L 1/053* (2006.01)
*F02F 1/24* (2006.01)
(Continued)

(52) U.S. Cl.
CPC ..... *F01L 1/053* (2013.01); *F01L 1/04* (2013.01); *F02F 1/24* (2013.01);
(Continued)

(58) Field of Classification Search
CPC ..... F01L 1/053; F01L 1/04; F01L 2001/0535; F01L 2001/0537; F02F 1/24; F02F 2001/244; F02B 2275/18
(Continued)

(56) References Cited

U.S. PATENT DOCUMENTS 4,825,818 A * 5/1989 Hamamura ..... F01L 1/02 123/41.86
5,220,853 A 6/1993 Sado et al.
(Continued)

FOREIGN PATENT DOCUMENTS

CN 1103852 C 3/2003
CN 1495342 A 5/2004
(Continued)

OTHER PUBLICATIONS

International Search Report and Written Opinion for related PCT Publication No. PCT/JP2016/082563, dated Nov. 29, 2016. English translation of ISR provided.
(Continued)

*Primary Examiner* — Patrick Hamo
*Assistant Examiner* — Wesley G Harris
(74) *Attorney, Agent, or Firm* — Procopio, Cory, Hargreaves & Savitch LLP

(57) ABSTRACT

A cam carrier includes a pair of longitudinal frames provided parallel to an axial direction of a camshaft and a plurality of transversal frames connected to the pair of longitudinal frames to be spaced from each other and supporting the camshaft via cam bearings. A flexible structure suppressing amounts of change in a relative position and an inclined angle of the cam bearings relative to the camshaft due to a thermal expansion is provided on at least one of wall surfaces of the longitudinal frames, the wall surfaces being located between adjacent transversal frames.

6 Claims, 6 Drawing Sheets

(51) Int. Cl.
*F01L 1/04* (2006.01)
*F01L 1/047* (2006.01)

(52) U.S. Cl.
CPC ..... *F01L 2001/0476* (2013.01); *F01L 2001/0535* (2013.01); *F01L 2810/04* (2013.01); *F02F 2001/244* (2013.01)

(58) Field of Classification Search
USPC ..... 123/193.5, 90.27, 90.34
See application file for complete search history.

(56) References Cited

U.S. PATENT DOCUMENTS

| | | | | |
|---|---|---|---|---|
| 5,435,281 | A | 7/1995 | Regueiro | |
| 5,669,344 | A | 9/1997 | Regueiro | |
| 2007/0240671 | A1* | 10/2007 | Imazato ..... | F01L 1/053 123/193.5 |

FOREIGN PATENT DOCUMENTS

| | | | |
|---|---|---|---|
| CN | 103403332 | A | 11/2013 |
| DE | 10346430 | A1 | 5/2005 |
| EP | 1847695 | A2 | 10/2007 |
| EP | 2679792 | A1 | 1/2014 |
| EP | 2767680 | A1 | 8/2014 |
| GB | 2049808 | A | 12/1980 |
| JP | H04-031656 | A | 2/1992 |
| JP | 2002-205159 | A | 7/2002 |
| JP | 2008-133749 | A | 6/2008 |
| JP | 2011-117423 | A | 6/2011 |

OTHER PUBLICATIONS

First Office Action for related CN App No. 201680065261.9 dated Sep. 30, 2019, 13 pgs.
Extended European Search Report for related European Application No. 16864094.4, dated Jun. 26, 2019; 8 pages.

* cited by examiner

CYLINDER HEAD STRUCTURE FOR INTERNAL COMBUSTION ENGINE AND INTERNAL COMBUSTION ENGINE

CROSS-REFERENCE TO RELATED APPLICATIONS

This application is a U.S. National Stage entry of PCT Application No: PCT/JP2016/082563 filed Nov. 2, 2016, which claims priority to Japanese Patent Application No. 2015-219400, filed Nov. 9, 2015, the contents of which are incorporated herein by reference.

TECHNICAL FIELD

The present disclosure relates to a cylinder head structure for an internal combustion engine and an internal combustion engine, in which a monolithic cam carrier is placed on a top of a cylinder head.

BACKGROUND ART

In general, most of internal combustion engines, such as diesel engines, are configured as a multi-cylinder engine provided with a plurality of cylinders. In a case where an OHC (overhead cam carrier) is employed for a valve mechanism in the multi-cylinder engine, multi-cylinder engine includes a camshaft having a plurality of cams for opening and closing an intake valve and an exhaust valve arranged on an upper portion of the inside of each cylinder, and the camshaft is rotatably supported by a cam carrier provided on the top of a cylinder head.

In the multi-cylinder OHC engine, the cam carrier includes a pair of longitudinal frames provided parallel to an axial direction of the camshaft and a plurality of transversal frames connected to the pair of longitudinal frames to be spaced from each other. The transversal frames are provided to correspond to the number of cylinders so as to be positioned between each of the cylinders of the engine. Also, cam bearings arranged on the respective transversal frames support the camshaft.

Further, since a coaxiality accuracy in machining cam bearing positions with respect to the respective cylinders has a great influence on reliability and durability, the longitudinal frames and the transversal frames are monolithic with each other and then coaxial machining is performed on such a monolithic structure, so that the cams on the camshafts can be arranged at correct positions. The monolithic cam carrier is fixed on the cylinder head by bolts.

However, if an internal combustion engine, in which the monolithic cam carrier is fixed on the top of a cylinder head, is under a running condition of the engine, under which a difference in temperature between the cam carrier and the cylinder head occurs, such as a running condition in which the engine is suddenly transmitted from a low load running such as a cold state to a high load running, or a running condition in which the engine is suddenly transmitted from the high load running to the low load running or a no-load running (a state where an engine brake is activated), there are problems that a relative displacement between the cylinder head and the cam carrier occurs due to a difference in temperature therebetween or that a thermal deformation occurs due to a difference in thermal expansion between a contact surface of the cam carrier with the cylinder head and an upper surface side of the cam carrier opposite thereto.

That is, when the engine running state is suddenly changed, an amount of heat emitted from the cylinders of the engine greatly changes. Therefore, a difference in temperature between the cylinder head and the cam carrier occurs and hence a relative displacement therebetween occurs due to a difference in thermal expansion caused by the difference in temperature. As a result, fretting which is a surface damage caused when minute reciprocating sliding repeatedly acts thereon occurs.

A contact surface side of the cam carrier which is contact with the cylinder head tends to follow the temperature of the cylinder head. An upper surface side of the cam carrier which is opposite to the cylinder head is difficult to follow the temperature of the cylinder head since a heat transfer thereto is slower and an amount of heat radiated therefrom is large. Therefore, a difference temperature occurs between the contact surface side and the upper surface side and a difference between an amount of thermal expansion of the contact surface side and an amount of thermal expansion of the upper surface side occurs, thereby causing a thermal deformation inside the cam carrier. If the thermal deformation is caused, a position or inclined angle of the cam bearings relative to the camshaft is changed, thereby causing problems, such as wear or seizing of the cam bearings.

That is, in a cylinder head structure 1X for an internal combustion engine according to the related art as shown in FIG. 6, if a cylinder head 10 is further thermally expanded ($\Delta Lb$) as a temperature thereof is suddenly increased from a normal state where a temperature of a cam carrier 20 is substantially even, a contact surface 20*r* side of the cam carrier 20 has a relatively large elongation amount $\Delta Lr$ by following a thermal expansion of the cylinder head 10, and hence a position Pr of a bolt 50, which is screwed in the cylinder head 10, on the contact surface 20*r* side is also displaced. On the other hand, an upper surface 20*t* side, from which a large amount of heat is radiated, cannot follow the increased temperature and hence has a relatively small elongation amount $\Delta Lt$. Therefore, a position Pt of the bolt 50 on the upper surface 20*t* side is offset from the position Pr on the contact surface 20*r* side. That is, the cam carrier 20 is thermally deformed due to a difference in thermal expansion therein. Meanwhile, FIG. 7 is a view schematically drawn focusing on elongation only in a lateral direction of FIG. 7 for the purpose of explanation, and thus the overall elongation, such as in a upward and downward direction, is not exactly shown therein. Also, when the temperature is increased, the relation "$\Delta Lb \geq Lr \geq Lt$" is obtained, whereas when the temperature is decreased, the relation "$\Delta Lb \leq Lr \leq Lt$" is obtained.

In this context, in order to prevent abnormal noises from being generated by an expansion of a camshaft pitch between an intake camshaft journal portion and an exhaust camshaft journal portion and an increment of a valve clearance, a cylinder head has been proposed, in which a cam carrier, which is separate from an aluminum cylinder head main body, is placed on the cylinder head main body, the cam carrier is fabricated by aluminum die-casting, and then cast iron bearing member is casted in the cam carrier, thereby reducing an amount of thermal deformation of the cam carrier (e.g., see Patent Document 1).

However, in this cylinder head, since the cast iron bearing member is casted in the aluminum cam carrier, there arises a problem that due to a difference in thermal expansion between aluminum alloy and cast iron, a thermal stress caused by a difference in amount of thermal deformation always acts outside a specific temperature range. In addition, since the amount of thermal expansion of the cam carrier is suppressed to be small, there arises a problem that a relative displacement between the cylinder head main body and the cam carrier placed thereon is increased.

CITATION LIST

Patent Document

Patent Document 1: JP-A-2002-205159

SUMMARY OF THE INVENTION

Problem that the Invention is to Solve

The present disclosure has been made keeping in mind the above problems. An object is to provide a cylinder head structure for an internal combustion engine and an internal combustion engine, in which even if an internal combustion engine, in which a monolithic cam carrier is placed on the top of a cylinder head, is under a running condition of the engine, under which a difference in temperature between the cylinder head and the cam carrier occurs, a relative displacement between the cylinder head and the cam carrier can be absorbed, thereby inhibiting contact sites between the cylinder head and the cam carrier from being damaged due to fretting, and also amounts of change in relative position and relative angle between the camshaft and the cam bearings can be reduced, thereby maintaining a coaxial machining accuracy of cam bearings arranged on respective transversal frames of the cam carrier and thus inhibiting wear or seizing of the cam bearings.

Means for Solving the Problems

In order to achieve the above object, the present disclosure provides a cylinder head structure for an internal combustion engine, wherein a monolithic cam carrier is placed on a top of a cylinder head, wherein the cam carrier includes a pair of longitudinal frames provided parallel to an axial direction of a camshaft and a plurality of transversal frames connected to the pair of longitudinal frames to be spaced from each other and supporting the camshaft via cam bearings, and wherein a flexible structure suppressing amounts of change in a relative position and an inclined angle of the cam bearings relative to the camshaft due to a thermal expansion is provided on at least one of wall surfaces of the longitudinal frames, the wall surfaces being located between adjacent transversal frames.

According to this configuration, the flexible structure can reduce a stiffness of the longitudinal frame in the axial direction of the camshaft, thereby absorbing a relative displacement between the cylinder head and the cam carrier caused by a difference in thermal expansion therebetween. Therefore, it is possible to inhibit contact surfaces between the cylinder head and the cam carrier from being damaged due to fretting.

Further, the flexible structure reduces the stiffness of the longitudinal frame in the axial direction of the camshaft, and therefore, the flexible structure can absorb a difference in thermal expansion between the upper surface side and the contact surface side of the longitudinal frame so as to inhibit an occurrence of wear or seizing of the cam bearing. In other words, the flexible structure can be deformed in the axial direction of the camshaft by an amount corresponding to the difference in thermal expansion, and therefore an influence of a thermal deformation, which is caused by a difference in thermal expansion occurring from unevenness in temperature created inside the cam carrier, on a relative position and an inclined angle of the cam bearings relative to the camshaft is reduced so as to inhibit an occurrence of wear or seizing of the cam bearings.

Also, in the cylinder head structure as described above, the flexible structure may be configured as a convex-shaped structure, in which a part or all of the at least one of the wall surfaces is formed in a convex shape in a direction perpendicular to the wall surfaces. The convex-shaped structure can be easily formed, for example, by pressing the wall surfaces of the longitudinal frames of the cam carrier in the direction perpendicular to the wall surfaces or the like. Further, according to this configuration, the flexible structure can be formed on the longitudinal frames of the cam carrier by a relatively simple processing, such as pressing, and also can be easily applied to existing engines.

Alternatively, in the cylinder head structure as described above, the flexible structure may be configured as a slit-shaped structure, in which at least one slit cut from a lower surface or an upper surface of the wall surfaces in a height direction of the longitudinal frames is provided on a part of the at least one of the wall surfaces. The slit-shaped structure can be easily formed, for example, by cutting in the height direction of the cylinder head or the like. Further, according to this configuration, the flexible structure can be formed on the longitudinal frames of the cam carrier by a relatively simple processing, such as cutting, and also can be applied to existing engines.

Further, in order to achieve the above object, the present disclosure provides an internal combustion engine including the cylinder head structure as described above. Thus, the internal combustion engine can exhibits the effects similar to those of the cylinder head structure as described above.

Effects of the Invention

According to the cylinder head structure for the internal combustion engine and the internal combustion engine of the present disclosure, even if the internal combustion engine, in which the monolithic cam carrier is placed on the top of the cylinder head, is under a running condition of the engine, under which a difference in temperature between the cylinder head and the cam carrier occurs, a relative displacement between the cylinder head and the cam carrier can be absorbed, thereby inhibiting contact sites between the cylinder head and the cam carrier from being damaged due to fretting. In addition, by absorbing a thermal deformation caused by unevenness in temperature inside the cam carrier, amounts of change in relative position and relative angle between the camshaft and the cam bearings can be reduced. Therefore, it is possible to maintain a coaxial machining accuracy of the cam bearings fitted on the respective transversal frames of the cam carrier, thereby inhibiting wear or seizing of the cam bearings.

MODE FOR CARRYING OUT THE INVENTION

Hereinafter, a cylinder head structure for an internal combustion engine and an internal combustion engine according to embodiments of the present disclosure will be described with reference to the accompanying drawings. In the following description, a so-called SOHC (single overhead cam carrier) engine, in which a single camshaft has a plurality of cams for opening and closing an intake valve and an exhaust valve arranged on an upper portion of the inside of each cylinder of the engine and is supported by a cam carrier, will be described by way of example. However, the present disclosure can be also applied to a so-called DOHC (double overhead camshaft) engine, in which two camshafts, including an intake valve camshaft having a plurality of cams for operating intake values and an exhaust valve camshaft having a plurality of cams for operating exhaust valves, are equipped on a cam carrier.

Figure 1:
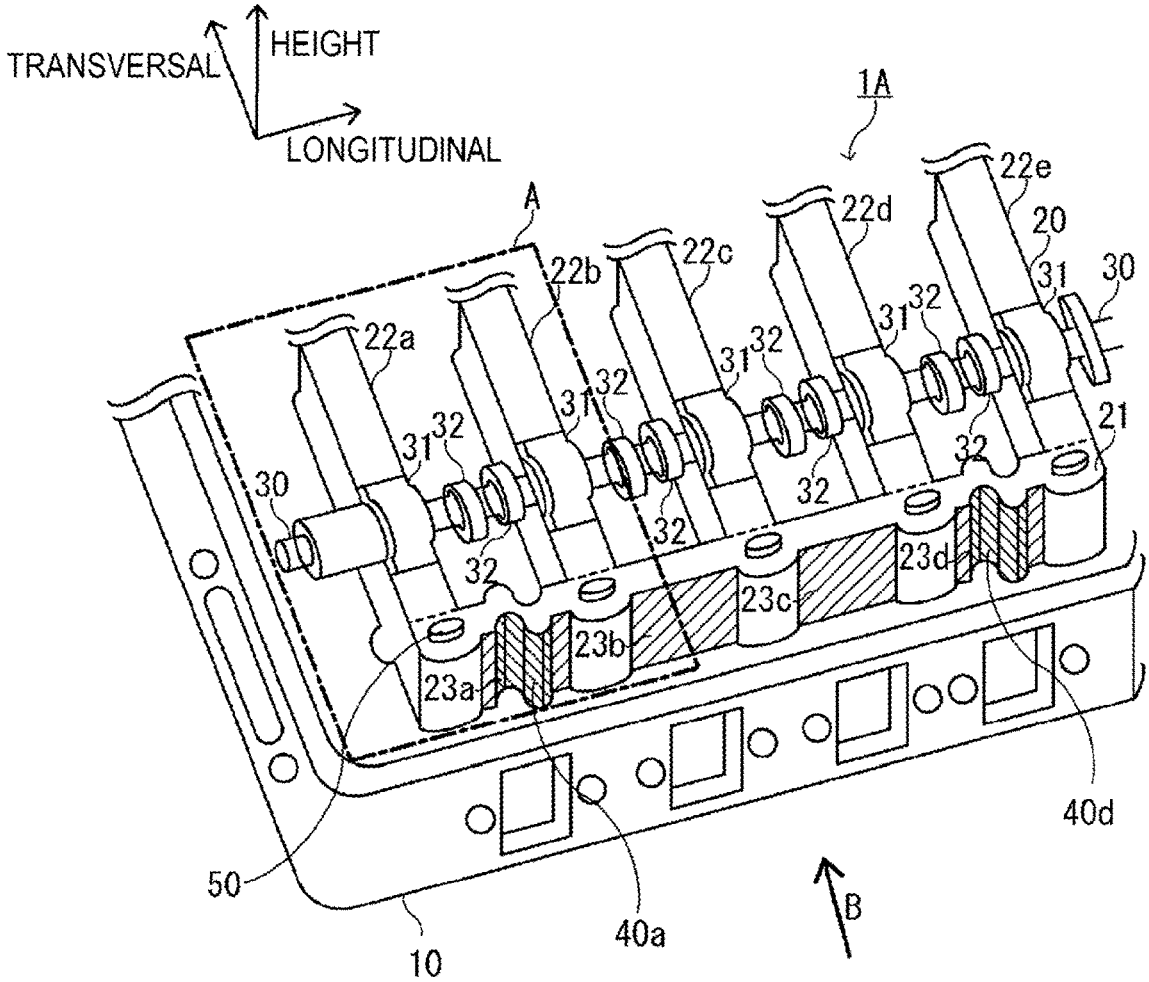
FIG. 1 is a view schematically showing a cylinder head structure for an internal combustion engine according to a first embodiment of the present disclosure.

A cylinder head structure 1A for an internal combustion engine according to a first embodiment of the present disclosure is a structure in which a monolithic cam carrier 20 is placed on the top of a cylinder head 10 and then is fixed thereto by bolts 50 as shown in FIG. 1.

Also, in the cylinder head structure 1 for the internal combustion engine, the cam carrier 20 includes a pair of longitudinal frames 21 provided parallel to an axial direction (longitudinal direction) of a camshaft 30 and a plurality of transversal frames 22 (22*a*, 22*b*, 22*c*, 22*d*, 22*e*) connected to the pair of longitudinal frames 21 to be spaced from each other and supporting the camshaft 30 via cam bearings 31.

Herein, directions as shown in FIG. 1 will be described. A longitudinal direction is a longitudinal direction of the cylinder head 20 and is the same as an axial direction of the camshaft 30. Also, this direction is the same as an axial direction of the cam bearings 31 arranged on the respective transversal frames 22 of the cam carrier 20. In addition, a transversal direction, which is perpendicular to the longitudinal direction, is a transversal direction of the cylinder head 10 and is the same as a direction along which each of the transversal frames 22 of the cam carrier 20 is arranged. Further, a height direction is a height direction of the cylinder head 10 and is perpendicular to the longitudinal direction and the transversal direction of the cylinder head 10.

The transversal frames 22 are provided to correspond to the number of cylinders (four cylinders in a configuration of FIG. 1) of the engine 1 and to straddle the respective cylinders as viewed from above. Also, the camshaft 30 is provided with a plurality of cams 32 for opening and closing intake valves and exhaust valves.

In the configuration of the present embodiment, a flexible structure 40 (40*a*, 40*d*) for suppressing amounts of change in a relative position and an inclined angle of the cam bearings 31 relative to the camshaft 30 due to a thermal expansion, is also provided on at least one wall surface (23*a*, 23*d*) (two wall surfaces in the configuration of FIG. 1) of wall surfaces 23 (23*a*, 23*b*, 23*c*, 23*d*) of the longitudinal frames 21, which are located between adjacent transversal frames 22. In FIG. 1, the longitudinal frame 21 arranged on a back side to the sheet is omitted for simplification of drawing, but the flexible structure 40 of the present disclosure as described below can be also applied to the longitudinal frame 21.

The flexible structure 40 is a structure configured to absorb a relative displacement between the cylinder head 10 and the cam carrier 20 by reducing a stiffness of the longitudinal frame 21 in the axial direction of the camshaft 30, i.e., in a direction along which a large relative displacement between the cylinder head 10 and the cam carrier 20 occurs. Also, the flexible structure 40 is a structure configured to absorb a difference in thermal expansion between an upper surface side and a contact surface side of the longitudinal frame 21, i.e., a structure in which the flexible structure 40 can be deformed in the axial direction of the camshaft 30 by an amount corresponding to the difference in thermal expansion.

In a case that the flexible structure 40 is provided on the wall surface on the end portion side (23*a*, 23*d* in FIG. 1) of the longitudinal frame 21, since a relative displacement between the cylinder head 10 and the cam carrier 20 can be absorbed at a site where the relative displacement is larger as compared with a case where the flexible structure 40 is provided on the wall surface (23*b*, 23*c* in FIG. 1) on the middle side thereof. Also, in a case where a thermal expansion of the transversal frames 22 becomes a problem, the flexible structure 40 may be provided on a wall surface of each of the transversal frames 22 of the cam carrier 20.

Figure 2:
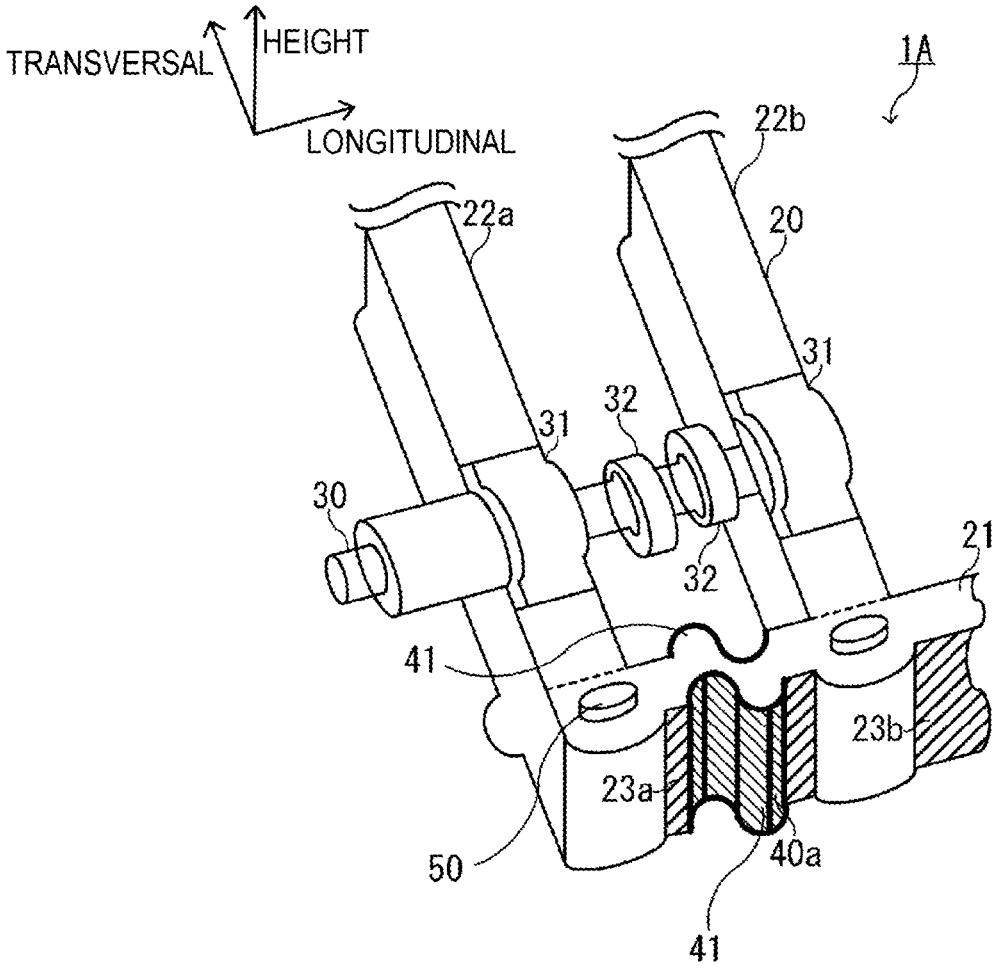
FIG. 2 is an enlarged view showing a section A in FIG. 1, illustrating a convex-shaped flexible structure provided on a longitudinal frame of a cam carrier.

In the cylinder head structure 1A for the internal combustion engine according to the first embodiment shown in FIG. 1, the flexible structure 40 is configured as a convex-shaped structure, as shown in FIG. 2, in which a part or all of at least one of the wall surfaces 23 of the longitudinal frame 21 of the cam carrier 20 is formed in a convex shape by providing thereon a protrusion 41 protruding in a direction perpendicular to the wall surfaces 23. The convex-shaped structure can be easily formed, for example, by pressing the wall surfaces 23 of the longitudinal frame 21 of the cam carrier 20 in the direction perpendicular to the wall surfaces 23 or the like. Also, according to this configuration, the flexible structure 40 can be formed on the longitudinal frame 21 of the cam carrier 20 by a relatively simple processing, such as pressing, and also can be easily applied to existing engines.

The detailed specification of the protrusion 41, such as a shape and dimensions, is set on a basis of an amount of relative displacement between the cylinder head 10 and the cam carrier 20 under an overrunning condition of the internal combustion engine, which is previously obtained by experiment, simulation and the like. Also, in a case where a plurality of protrusions 41 is provided on the wall surfaces 23, the detailed specification of each flexible structure 40, such as a shape and dimensions, is set in the same manner.

Figure 3:
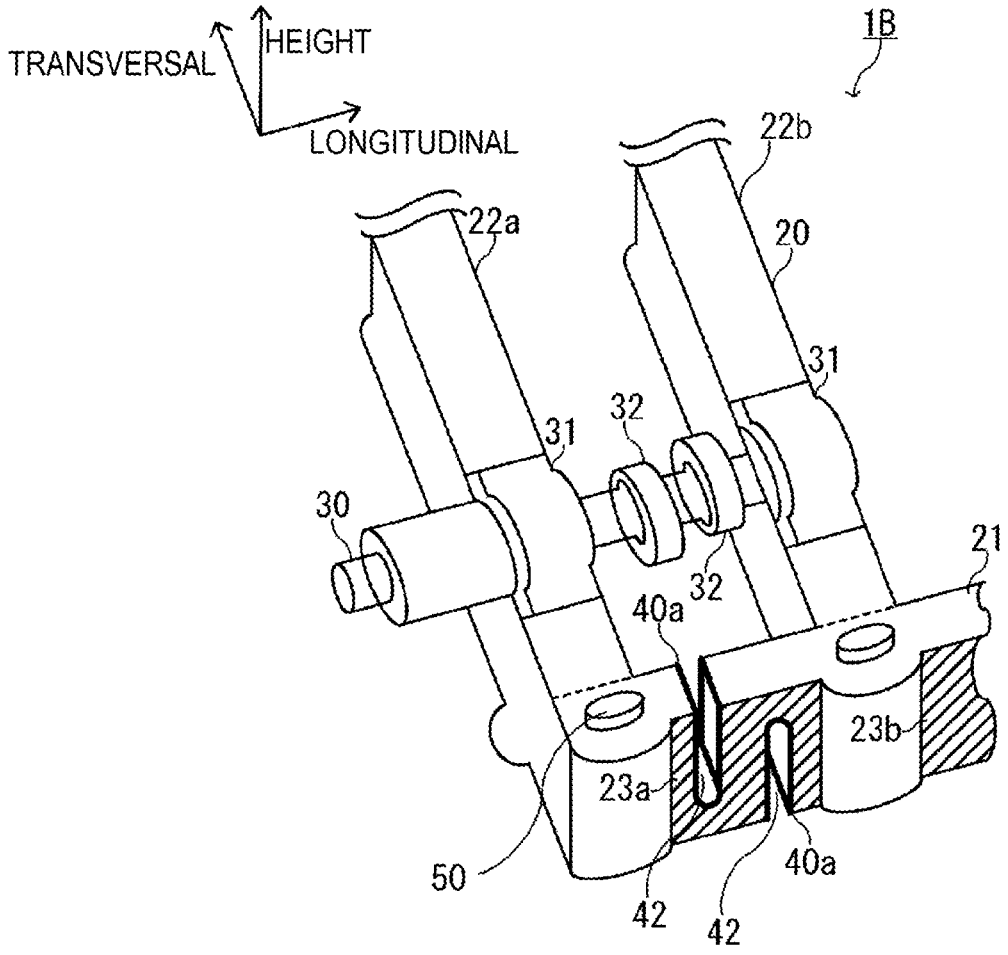
FIG. 3 is an enlarged view showing a section of a cylinder head structure for an internal combustion engine according to a second embodiment of the present disclosure corresponding to the section A in FIG. 1, illustrating a slit-shaped flexible structure provided on a longitudinal frame of a cam carrier.
Figure 4:
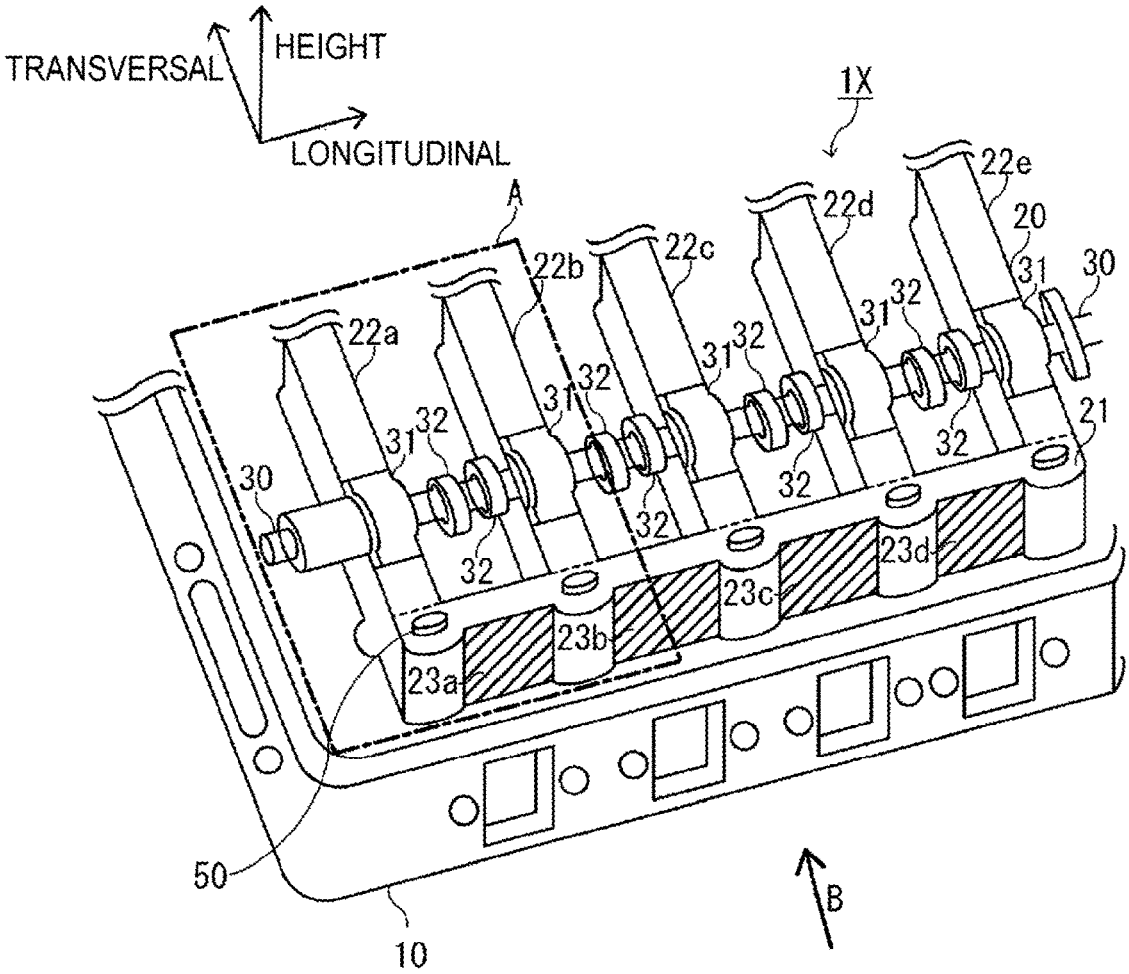
FIG. 4 is a view schematically showing a configuration of an internal combustion engine according to the related art.
Figure 5:
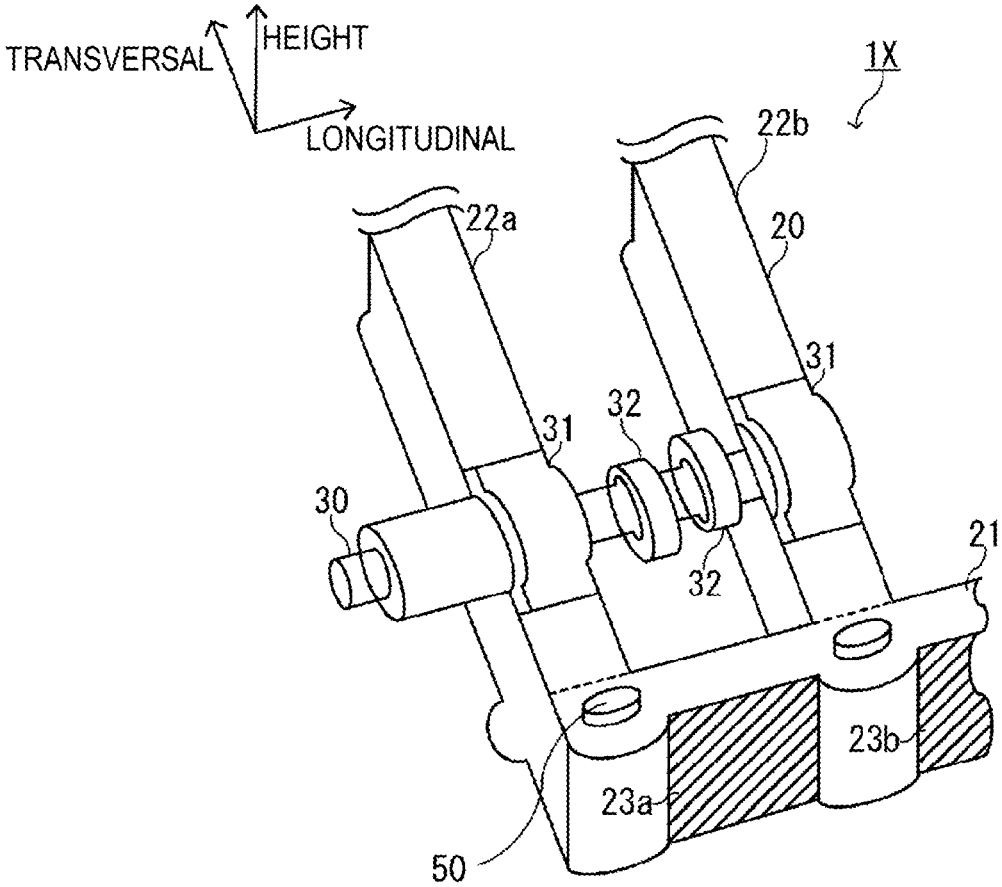
FIG. 5 is an enlarged view showing a section A in FIG. 4.
Figure 6:
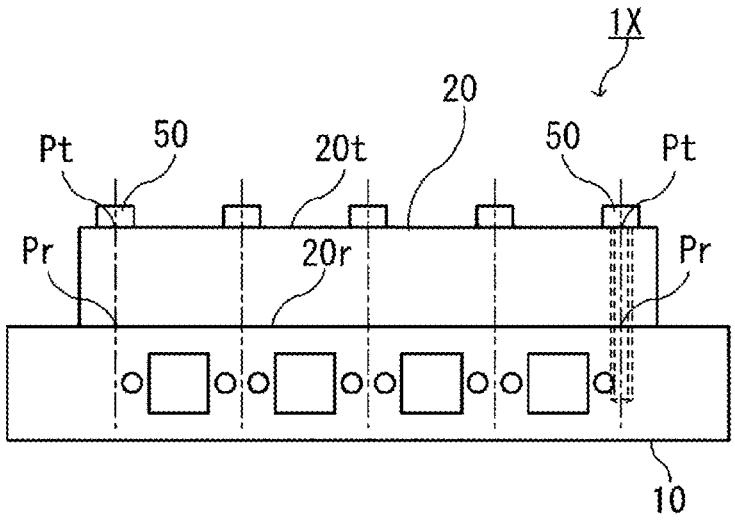
FIG. 6 is a view showing when viewing FIG. 5 in a B direction, schematically illustrating a positional relationship between a cylinder head and a cam carrier of the related art under a normal running condition of the engine.
Figure 7:
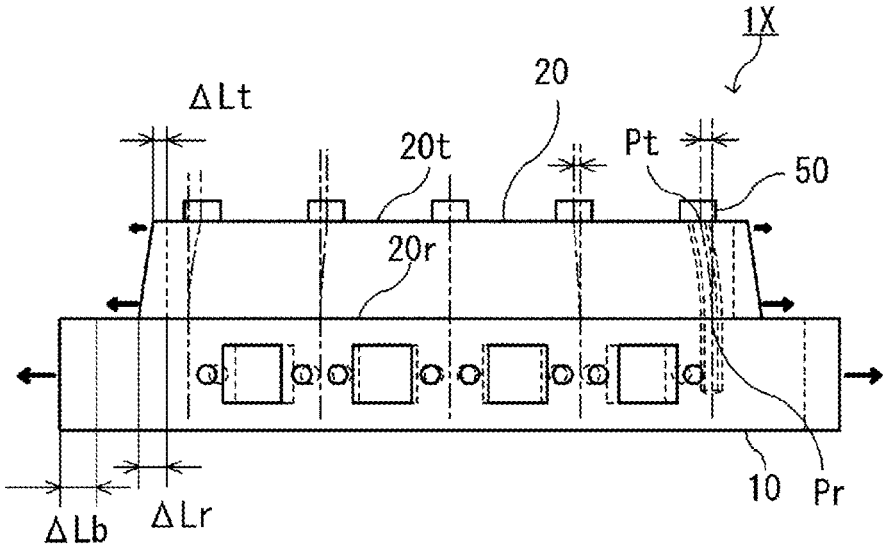
FIG. 7 is a view showing when viewing FIG. 5 in the B direction, schematically illustrating a positional relationship between the cylinder head and the cam carrier of the related art and a deformation of the cam carrier under an overrunning condition of the engine.

Further, in a cylinder head structure 1B for an internal combustion engine according to a second embodiment shown in FIG. 3, the flexible structure 40 (40*a* in FIG. 3) is configured as a slit-shaped structure, in which at least one slit 42 cut from a lower surface or an upper surface of the wall surfaces 23 in the height direction of the longitudinal frames is provided on a part of the at least one of the wall surfaces 23. The slit-shaped structure can be easily formed, for example, by cutting in the height direction of the cylinder head 10 or the like. Also, according to this configuration, the flexible structure 40 can be formed on the longitudinal frame 21 of the cam carrier 20 by a relatively simple processing, such as cutting, and also can be applied to existing engines.

The detailed specification of the slit-shaped structure 40, such as a shape and dimensions, is set on the basis of an amount of relative displacement between the cylinder head 10 and the cam carrier 20 under an overrunning condition of the engine 1, which is previously obtained by experiment, simulation and the like. Also, in a case where a plurality of slits 42 is provided on the wall surfaces 23, the detailed specification of each flexible structure 40, such as a shape and dimensions, is set in the same manner.

Further, an internal combustion engine according to an embodiment of the present disclosure includes at least one of the cylinder head structures 1A, 1B for the internal combustion engine according to the first and second embodiments as described above.

According to the cylinder head structures 1A, 1B and the internal combustion engine configured as described above, the flexible structure 40 can reduce a stiffness of the longitudinal frame 21 in the axial direction of the camshaft 30, thereby absorbing a relative displacement between the cylinder head 10 and the cam carrier 20 caused by a difference in thermal expansion therebetween. Therefore, it is possible to inhibit contact surfaces between the cylinder head 10 and the cam carrier 20 from being damaged due to fretting.

Further, by reducing the stiffness of the longitudinal frame 21 in the axial direction of the camshaft 30, the flexible structure 40 can absorb a difference in thermal expansion between the upper surface side and the contact surface side of the longitudinal frame 21 so as to inhibit an occurrence of wear or seizing of the cam bearings 31. In other words, the flexible structure 40 can be deformed in the axial direction of the camshaft 30 by an amount corresponding to the difference in thermal expansion, and therefore an influence of a thermal deformation, which is caused by a difference in thermal expansion occurring from unevenness in temperature created inside the cam carrier 20, on a relative position and an inclined angle of the cam bearings 31 relative to the camshaft 30 is reduced so as to inhibit the occurrence of wear or seizing of the cam bearings 31.

As a result, in the cylinder head structure 1A, 1B for the internal combustion engine and the internal combustion engine, in which the monolithic cam carrier 20 is placed on the top of the cylinder head 10, a relative displacement between the cylinder head 10 and the cam carrier 20 can be absorbed even under a running condition of the engine, under which a difference in temperature between the cylinder head 10 and the cam carrier 20 occurs, thereby inhibiting contact sites between the cylinder head 10 and the cam carrier 20 from being damaged due to fretting. In addition, by absorbing a thermal deformation caused by unevenness in temperature inside the cam carrier 20, amounts of change in relative position and relative angle between the camshaft 30 and the cam bearings 31 can be reduced. Therefore, it is possible to maintain a coaxial machining accuracy of the cam bearings 31 arranged on the respective transversal frames 22 of the cam carrier 20, thereby inhibiting wear or seizing of the cam bearings 31.

Further, according to the present disclosure, there is provided a cylinder head structure for an internal combustion engine, including:

a cylinder head; and a cam carrier attached on the top of the cylinder head, the cam carrier including:

a pair of longitudinal frames extending in a direction parallel to an axial direction of a camshaft; and a plurality of transversal frames extending in a direction intersecting with the pair of longitudinal frames and each having a cam bearing attached thereon to support the camshaft, wherein the pair of longitudinal frames includes a flexible structure provided on at least a part of a plurality of wall portions connecting the plurality of transversal frames and absorbing a deformation of the cam carrier due to a thermal expansion.

This application is based on Japanese Patent Application No. 2015-219400 filed on Nov. 9, 2015, the entire contents of which are incorporated herein by reference.

INDUSTRIAL APPLICABILITY

The cylinder head structure for the internal combustion engine and the internal combustion engine according to the present disclosure exhibit the effects that it is possible to inhibit contact sites between the cylinder head and the cam carrier from being damaged due to fretting and also to inhibit wear or seizing of the cam bearings, and thus are useful in that performance or durability of the internal combustion engine can be enhanced with a simple structure.

REFERENCE NUMERALS LIST

1A, 1B, 1X Cylinder head structure for an internal combustion engine
10 Cylinder head
20 Cam carrier
20*r* Contact surface
20*t* Upper surface
21 Longitudinal frame
22 (22*a*, 22*b*, 22*c*, 22*d*, 22*e*) Transversal frame
23 (23*a*, 23*b*, 23*c*, 23*d*) Wall surface of the longitudinal frame between the transversal frames
30 Camshaft
31 Cam bearing
32 Cam
40, 40*a*, 40*d* Flexible structure
41 Protrusion
42 Slit
50 Bolt
Pr Position of the center of the bolt on the contact surface
Pt Position of the center of the bolt on the upper surface

The invention claimed is:

1. A cylinder head structure for an internal combustion engine, the cylinder head structure comprising:

a cylinder head; and a monolithic cam carrier placed on a top of the cylinder head, the monolithic cam carrier including:

a pair of longitudinal frames provided parallel to an axial direction of a camshaft;

a plurality of transversal frames connected to the pair of longitudinal frames to be spaced from each other and supporting the camshaft via cam bearings; and a flexible structure provided on at least one wall surface of a plurality of wall surfaces of the pair of longitudinal frames, and suppressing change due to a thermal expansion in a relative position and an inclined angle of the cam bearings relative to the camshaft, the at least one wall surface being located between adjacent transversal frames of the plurality of transversal frames, wherein the at least one wall surface of the pair of longitudinal frames is in contact with the cylinder head.

2. The cylinder head structure according to claim 1, wherein the flexible structure is configured as a convex-shaped structure, in which a part or all of the at least one wall surface is formed in a convex shape in a direction perpendicular to the at least one wall surface.

3. The cylinder head structure according to claim 1, wherein the flexible structure is configured as a slit-shaped structure, in which at least one slit cut from a lower surface or an upper surface of the at least one wall surface in a height direction of the pair of longitudinal frames is provided on a part of the at least one wall surface.

4. An internal combustion engine comprising the cylinder head structure according to claim 1.

5. A cylinder head structure fir an internal combustion engine, the cylinder head structure comprising:

a cylinder head; and a cam carrier attached on a top of the cylinder head, the cam carrier including:

a pair of longitudinal frames extending in a direction parallel to an axial direction of a camshaft; and a plurality of transversal frames extending in a direction intersecting with the pair of longitudinal frames, each transversal frame including a cam bearing that is attached on each transversal frame and supports the camshaft, wherein the pair of longitudinal frames includes a flexible structure provided on at least a part of a plurality of wall portions connecting the plurality of transversal frames and absorbing a deformation of the cam carrier due to a thermal expansion, wherein the at least a part of the plurality of wall portions provided with the flexible structure of the pair of longitudinal frames is in contact with the cylinder head.

6. A cylinder head structure for an internal combustion engine, the cylinder head structure comprising:

a cylinder head; and a monolithic cam carrier placed on a top of the cylinder head, the monolithic cam carrier including:

a pair of longitudinal frames provided parallel to an axial direction of a camshaft;

a plurality of transversal frames connected to the pair of longitudinal frames to be spaced from each other and supporting the camshaft via cam bearings; and a flexible structure provided on at least one wall surface of a plurality of wall surfaces of the pair of longitudinal frames and suppressing change due to a thermal expansion in a relative position and an inclined angle of the cam bearings relative to the camshaft, the at least one wall surface being located between adjacent transversal frames of the plurality of transversal frames, wherein the flexible structure is configured as a slit-shaped structure, in which at least one slit cut from a lower surface or an upper surface of the at least one wall surface in a height direction of the pair of longitudinal frames is provided on a part of the at least one wall surface.

* * * * *